US007905179B2

(12) United States Patent
Brock

(10) Patent No.: US 7,905,179 B2
(45) **Date of Patent: *Mar. 15, 2011**

(54) NON-PYROTECHNIC EXPLOSION DEVICE

(76) Inventor: Nathan R. Brock, Toccoa, GA (US)

( * ) Notice: Subject to any disclaimer, the term of this patent is extended or adjusted under 35 U.S.C. 154(b) by 621 days.

This patent is subject to a terminal disclaimer.

(21) Appl. No.: 11/879,530

(22) Filed: Jul. 17, 2007

(65) Prior Publication Data

US 2011/0017187 A1 Jan. 27, 2011

Related U.S. Application Data

(63) Continuation of application No. 10/976,288, filed on Oct. 27, 2004, now Pat. No. 7,261,041.

(60) Provisional application No. 60/514,586, filed on Oct. 27, 2003.

(51) Int. Cl.
*F42B 8/00* (2006.01)

(52) U.S. Cl. ..... 102/498; 102/367

(58) Field of Classification Search ..... 102/367, 102/498, 407; 473/577; 222/5, 389; 434/15, 434/16

See application file for complete search history.

(56) References Cited

U.S. PATENT DOCUMENTS

| | | | | | |
|---|---|---|---|---|---|
| 2,690,279 | A * | 9/1954 | Ward | 222/402.14 |
| 3,380,383 | A * | 4/1968 | Schnepfe, Jr. | 102/368 |
| 3,512,480 | A * | 5/1970 | Barr | 102/368 |
| 3,656,435 | A * | 4/1972 | Barr et al. | 102/368 |
| 3,747,805 | A * | 7/1973 | Lee | 222/82 |
| 4,392,432 | A * | 7/1983 | Fenrick et al. | 102/334 |
| 4,664,631 | A * | 5/1987 | Pederson et al. | 434/16 |
| 4,690,061 | A * | 9/1987 | Armer et al. | 102/401 |
| 5,018,449 | A * | 5/1991 | Eidson, II | 102/498 |
| 5,844,164 | A * | 12/1998 | Cabrera | 102/288 |
| 6,209,461 | B1 * | 4/2001 | Riffet et al. | 102/513 |
| 6,488,557 | B1 * | 12/2002 | Elliott et al. | 446/220 |
| 6,598,807 | B1 * | 7/2003 | Anzalone | 239/302 |
| 6,871,594 | B1 * | 3/2005 | Estrella | 102/498 |
| 7,261,041 | B2 * | 8/2007 | Brock | 102/498 |
| 7,387,072 | B2 * | 6/2008 | Hunn et al. | 102/481 |
| 7,412,929 | B2 * | 8/2008 | Walsh | 102/368 |
| 2004/0149780 | A1 * | 8/2004 | Poile et al. | 222/386 |

* cited by examiner

*Primary Examiner* — Benjamin P Lee
(74) *Attorney, Agent, or Firm* — Lewinski Law Group LLC

(57) ABSTRACT

A "non-pyrotechnic explosion device" closely replicates in sound and visual cue a "real" exploding device, but without the accompanying safety concerns. This device is not only realistic and safe, but is inexpensive to operate and maintain, durable, and easy to transport and operate. It provides the user with numerous options for employment from mine, bomb, and improvised explosive device (ied) simulators to an artillery impact simulator. The device is comprised of a pressurized chamber, a pressure release device, an expulsion substance container, and a rupture-able/explosion tube assembly.

4 Claims, 2 Drawing Sheets

NON-PYROTECHNIC EXPLOSION DEVICE

CROSS REFERENCE TO RELATED APPLICATIONS

This application is a continuation of application Ser. No. 10/976,288, filed Oct. 27, 2004, which claims the benefit of U.S. Provisional Application No. 60/514,586, filed Oct. 27, 2003.

BACKGROUND

The military and law enforcement (LE) communities are more frequently facing non-traditional threats from mines, booby traps and improvised explosive devices (IEDs); all of which have the potential to be combined with lethal gases, chemicals and even nuclear material to form weapons of mass destruction (WMDs).

In the past, in an attempt to make training more relevant, the military and LE communities have relied on potentially dangerous pyrotechnic simulators or complex, expensive, and/or unrealistic electronic simulators.

In the civilian community, recreational scenario garners (paintball, airsoft, etc.) are always looking for more "realistic" yet safe ways to replicate scenarios encountered by the military and LE communities. Part of the "realism" is scenarios where ordnance threats are present and potentially (simulated) dangerous.

To improvise, the civilian community has had to settle for "dud" simulators that relied on referees to make wound/kill calls or more recently, rely on mines/grenades that expel a marking paint that would create a simulated fragmentation on the victim(s), but provide no other visual or audible cue that a detonation has occurred. They also had the option of using cheap and potentially dangerous PVC mines that could not withstand the rigors of multiple, even simulated, explosions and therefore were a liability to their users.

In either case, there were no simulators that combined all of the most desirable elements in one device to provide an explosion simulator that is: "realistic" (loud report and visual signal/simulated smoke), safe (non pyrotechnic), durable, inexpensive to purchase and operate (reusable), simple, and reliable.

As a result, there became a demand from both the mil/LE communities as well as the recreational scenario community, for simulators that combined these desired elements into both special purpose and general purpose explosion simulators.

SUMMARY

It is an objective of this invention to meet the training needs of the military/law enforcement community and recreational scenario re-enactors while addressing the deficiencies in current ordnance: safety issues, expense in cost and operation, unrealistic results, complex operation, and/or cumbersomeness in transport and operation.

1. This invention addresses the safety issues of current ordnance simulators by incorporating a non-pyrotechnic charge used in conjunction with an expandable and rupturable membrane such as an explosion tube.

2. This invention addresses the high initial and operational costs of current ordnance simulators by having a comparably low initial cost, and a comparably low operational cost. The fact that this invention is reusable further adds to its cost efficiency.

3. This invention addresses the unrealistic nature of current ordnance simulators by providing upon detonation both a loud audible report and an obvious visual cue; that being a simulant expulsion.

4. This invention addresses the complexity issues of current high end ordnance simulators by having a minimal number of moving parts requiring little training and maintenance.

5. This invention addresses the cumbersomeness issues of some current ordnance simulators by being designed to be both small and light relative to the desired output of the device. One individual can easily transport and emplace this device.

In accordance with an exemplary embodiment of this invention, a non-pyrotechnic explosion device comprises:

1. A pressurized chamber;
2. A pressure release device;
3. An expulsion substance container with a detachable expulsion substance container cap on the discharge end containing a discharge opening; and
4. A ruptureable explosion tube assembly having an expandable and rupturable membrane having a rigid tube inserted at its intake and being sealed on the opposite end.

The pressurized chamber is a storage container for the pressurized gas which is used as a propellant in the operation of the invention.

The pressure release device is a mechanically or electrically actuated device used to regulate the flow of the pressurized gas.

The expulsion substance container is a storage container for any substance required, having a discharge opening through which the substance passes upon activation, creating the desired effect for the user when combined with the other device elements.

The rupturable explosion tube assembly includes an expandable rupturable membrane in the form of an explosion tube that has a rigid tube inserted into the intake opening and is then placed through the expulsion substance container cap discharge opening with the sealed end of the rupturable membrane residing outside the storage container and the intake end residing inside the storage tank when the cap is attached.

Upon mechanical or electrical activation, the pressure release device allows the compressed gas to escape from the pressurized chamber into the expulsion substance container whereby it forces itself and any substance contained in said chamber through the expulsion substance container cap discharge opening and into the rupturable explosion tube, expanding said tube to the point of rupture, creating a loud report and discharging contents of the expulsion substance container into the air.

DETAILED DESCRIPTION OF THE INVENTION

Figure 1:
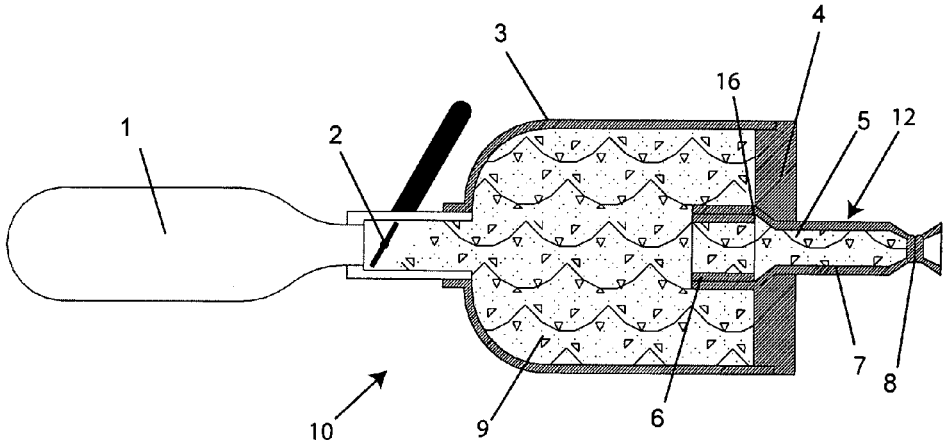
FIG. 1 is a schematic of a non-pyrotechnic explosion device of the present invention in its safe and ready to use position.

Referencing FIG. 1, operational aspects and advantages of the present invention will first be described. A non-pyrotechnic explosion device 10 of the present invention is shown in its safe and ready position.

The non-pyrotechnic explosion device 10 has application in both military/law enforcement training and recreational scenario war-gaming to replicate the threat or actual detonation of a simulated ordnance device providing both an audible report and a visual cue represented by the expulsion of a training/scenario specific substance.

In general, training/scenario specific substance can include a non-lethal, less-than-lethal, or lethal substance.

The non pyrotechnic explosion device includes a pressurized chamber 1 that stores a compressed propellant (e.g., $CO_2$, nitrogen, compressed air, etc.). Attached to the pressurized chamber is a pressure release device 2. This pressure release device 2 is mechanical in its operation, but can be actuated by several means, some of which are; electric solenoid, lever operated valve, or a combination spring/hammer/puncture pin.

Next in line is the expulsion substance container 3. The expulsion substance container 3 is used as a reservoir for holding the desired expulsion agent 9. The types of expulsion agents that can be used are only limited by the imagination of the user. Some of the more commonly used agents are colored powder (e.g. to simulate smoke, chemical agents, biological agents, distress/warning signals etc.), liquid paint (e.g. for marking a target/victim), less-than lethal irritants (powder or liquid), water, or if an audible report is the only effect desired, the expulsion substance container 3 acts as an expansion chamber for the released propellant.

On the discharge end of the expulsion substance container 3 is a detachable threaded cap 4. This expulsion substance container cap 4 is removed to fill the container 3 with the desired expulsion agent. This cap 3 also has a discharge opening 5 that is used to secure the ruptureable/explosion tube assembly 12. This assembly 12 consists of a rigid expansion tube 5 and an expandable rupturable membrane in the form of an explosion tube 7.

This rigid expansion tube 5 is inserted into one end of the explosion tube 7 in the factory and the other end of the explosion tube 7 is sealed 8, also at the factory.

Because the O.D. of the expansion tube 6 is larger than the I.D. of the explosion tube 7, when it is inserted into the explosion tube 7, the expansion tube 6 acts as a coupler and stretches the end of the explosion tube 7 over a shoulder 16 of the expansion tube 6 to a size larger than the O.D. of the cap's 4 discharge opening 5. This allows the explosion tube 7 to remain secured to the device upon activation and detonation.

When assembled, the explosion tube's 7 sealed end 8 is pointing out toward the intended target. The device is now ready to be detonated.

Figure 2:
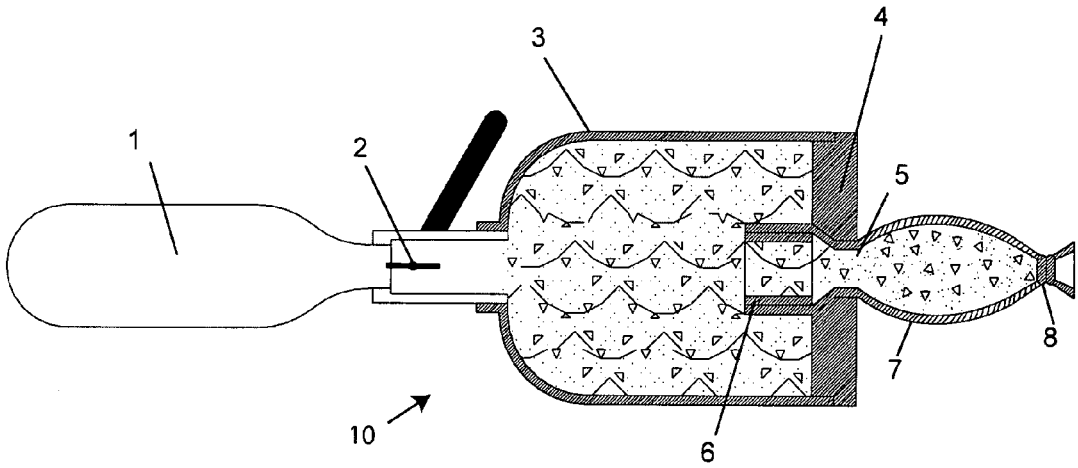
FIG. 2 shows the non-pyrotechnic explosion device of FIG. 1 with an expanded explosion tube.
Figure 3:
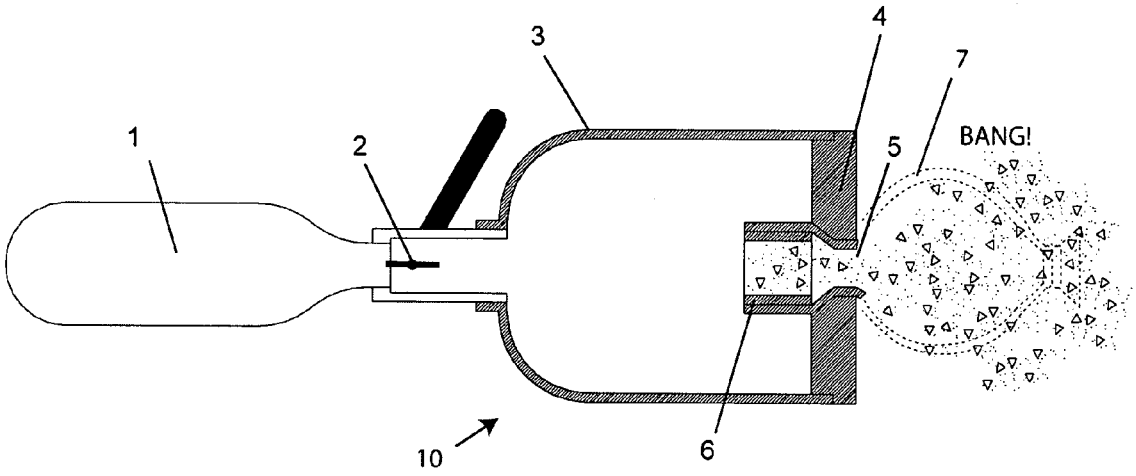
FIG. 3 shows the non-pyrotechnic explosion device of FIG. 1 in which the explosion tube ruptures.

When activated via electric or manual means, the pressure release device 2 releases the compressed propellant from the pressurized chamber to the expulsion substance container 3. Upon entering this container 3, expanding gas forces itself and the contents of the container 3 through the discharge opening 5 and into the explosion tube 7, thereby expanding it (FIG. 2). Further pressure expands the explosion tube 7 to the point of rupture, resulting in a loud report and expelling contents of the expulsion substance container 3 into the air (FIG. 3).

What is claimed is:

1. An apparatus, comprising:

a pressure chamber;

an expulsion substance container coupled to said pressure chamber at a first end, said expulsion substance container having a second end open for receiving an expulsion substance;

a pressure release device between said pressure chamber and said expulsion substance container for releasing compressed gas from said pressure chamber into the expulsion substance container;

a detachable cap coupled to said open second end of said expulsion substance container;

an expandable rupturable membrane coupled to said detachable cap, wherein said detachable cap and said expandable rupturable membrane seal said second open end; and a rigid tube inserted within said expandable rupturable membrane.

2. The apparatus of claim 1, wherein said expandable rupturable membrane has a first portion within said expulsion substance container and a second portion exterior said expulsion substance container.

3. The apparatus of claim 1, wherein said rigid tube is within said expulsion substance container to couple said expandable rupturable membrane to said expulsion substance container.

4. The apparatus of claim 3, wherein said outer diameter of said rigid tube is greater than the diameter of said discharge opening.

* * * * *